US010460664B2

(12) United States Patent
Li

(10) Patent No.: US 10,460,664 B2
(45) Date of Patent: Oct. 29, 2019

(54) PIXEL COMPENSATION CIRCUIT, SCANNING DRIVING CIRCUIT AND DISPLAY DEVICE

(71) Applicant: Shenzhen China Star Optoelectronics Technology Co., Ltd., Shenzhen, Guangdong (CN)

(72) Inventor: Guang Li, Guangdong (CN)

(73) Assignee: Shenzhen China Star Technology Co., Ltd, Shenzhen, Guangdong (CN)

( * ) Notice: Subject to any disclaimer, the term of this patent is extended or adjusted under 35 U.S.C. 154(b) by 220 days.

(21) Appl. No.: 15/541,369

(22) PCT Filed: May 27, 2017

(86) PCT No.: PCT/CN2017/086302
§ 371 (c)(1),
(2) Date: Jul. 1, 2017

(87) PCT Pub. No.: WO2018/201544
PCT Pub. Date: Nov. 8, 2018

(65) Prior Publication Data

US 2018/0322828 A1 Nov. 8, 2018

(51) Int. Cl.
*G09G 3/32* (2016.01)
*G09G 3/3233* (2016.01)
(Continued)

(52) U.S. Cl.
CPC ..... *G09G 3/3258* (2013.01); *G09G 3/3233* (2013.01); *G09G 3/3266* (2013.01);
(Continued)

(58) Field of Classification Search
CPC .. G09G 3/30; G09G 3/32; G09G 3/38; G09G 3/325; G09G 3/3266; G09G 3/3233;
(Continued)

(56) References Cited

U.S. PATENT DOCUMENTS

2010/0039458 A1* 2/2010 Nathan ..... G09G 3/3233 345/698
2014/0340290 A1* 11/2014 Ono ..... G09G 3/3233 345/77
(Continued)

FOREIGN PATENT DOCUMENTS

CN 103150992 A 6/2013
CN 104157241 A 11/2014
(Continued)

*Primary Examiner* — Chanh D Nguyen
*Assistant Examiner* — Nguyen H Truong
(74) *Attorney, Agent, or Firm* — Andrew C. Cheng

(57) ABSTRACT

The disclosure provides a pixel compensation circuit, a scanning driving circuit and a display device. A control terminal of a first switch and that of a third switch are connected with a scanning line. A first terminal of the first switch is connected with a reference voltage terminal. A second terminal is connected with a first terminal of a second switch. A control terminal of the second switch and that of the fourth switch are connected with a light-emitting control terminal. A first terminal of the third switch is connected with the data cable. A second terminal is connected with a second terminal of the second switch and a control terminal of a driving switch. An anode of a diode is connected with a second terminal of the driving switch. A first terminal of the fourth switch is connected with a first voltage terminal.

4 Claims, 4 Drawing Sheets

(51) Int. Cl.
*G09G 3/3258* (2016.01)
*G09G 3/3266* (2016.01)

(52) U.S. Cl.
CPC ..... *G09G 2300/0819* (2013.01); *G09G 2300/0842* (2013.01); *G09G 2300/0866* (2013.01); *G09G 2310/0281* (2013.01); *G09G 2310/08* (2013.01); *G09G 2320/0233* (2013.01)

(58) Field of Classification Search
CPC .. G09G 3/3225; G09G 3/3258; G09G 3/2092; G09G 3/3291; H01L 27/12; H01L 27/32; H01L 27/3265; H01L 27/3262; H01L 27/3276; H01L 27/1255; H01L 51/52; H01L 51/5221; H01L 51/5206; H01L 51/5012; G06F 3/038
See application file for complete search history.

(56) References Cited

U.S. PATENT DOCUMENTS

| | | | | |
|---|---|---|---|---|
| 2015/0379956 | A1* | 12/2015 | Nonaka | G09G 3/3233 315/172 |
| 2017/0039944 | A1 | 2/2017 | Ma | |
| 2017/0147121 | A1* | 5/2017 | Yang | G06F 3/044 |
| 2017/0186372 | A1* | 6/2017 | Yanase | G09G 3/3233 |

FOREIGN PATENT DOCUMENTS

| | | | |
|---|---|---|---|
| CN | 104867441 | A | 8/2015 |
| CN | 105405402 | A | 3/2016 |
| KR | 20140086466 | A | 7/2014 |

* cited by examiner

PIXEL COMPENSATION CIRCUIT, SCANNING DRIVING CIRCUIT AND DISPLAY DEVICE

FIELD OF THE DISCLOSURE

The disclosure relates to a display technical field, and more particularly to a pixel compensation circuit, a scanning driving circuit and a display device.

BACKGROUND

OLED display devices have been developed rapidly in recent years due to superior properties such as wide color gamut, the high contrast ratio and so on, which are more and more competitive in the display realm. The conventional OLED display devices basically adopt the active driving manner. As the organic light-emitting diode is a current device, precise control of the current has been a critical consideration.

The conventional pixel compensation circuit consists of two thin film transistors and a memory capacitor, as shown in FIG. 1. The pixel compensation circuit includes a controllable switch T1, a driving switch T2 and a memory capacitor C1. The driving current of the organic light-emitting diode D1 is controlled by the driving switch T2, the current thereof is $I_{OLED}=k(V_{gs}-V_{th})^2$, where k is a current amplification coefficient of the driving switch T2, which is determined by the inherent property of the driving switch T2, Vth is a threshold voltage of the driving switch T2. As the threshold voltage Vth of the driving switch T2 can easily shift, the organic light-emitting diode D1 drives the current to be changed, which leads to the brightness of the OLED display device to be uneven, further affecting image quality.

SUMMARY

An embodiment of the disclosure provides a pixel compensation circuit, a scanning driving circuit and a display device to solve the problem of uneven brightness of the panel caused by the bias of the threshold voltage.

In order to solve the technical problem above, the disclosure provides a pixel compensation circuit, including a first controllable switch, a second controllable switch, a third controllable switch, a driving switch, an organic light-emitting diode, a fourth controllable switch, and a memory capacitor.

The first controllable switch includes a control terminal, a first terminal and a second terminal. The control terminal of the first controllable switch is connected with a scanning line. The first terminal of the first controllable switch is connected with a reference voltage terminal.

The second controllable switch includes a control terminal, a first terminal and a second terminal. The control terminal of the second controllable switch is connected with a light-emitting control terminal. The first terminal of the second controllable switch is connected with the second terminal of the first controllable switch.

The third controllable switch includes a control terminal, a first terminal and a second terminal. The control terminal of the third controllable switch is connected with the scanning line. The first terminal of the third controllable switch is connected with a data cable. The second terminal of the third controllable switch is connected with the second terminal of the second controllable switch.

The driving switch includes a control terminal, a first terminal and a second terminal. The control terminal of the driving switch is connected with the second terminal of the second controllable switch and the second terminal of the third controllable switch.

The organic light-emitting diode includes an anode and a cathode. The anode of the organic light-emitting diode is connected with the second terminal of the driving switch. The cathode of the organic light-emitting diode is connected with a ground.

The fourth controllable switch includes a control terminal, a first terminal and a second terminal. The control terminal of the fourth controllable switch is connected with the light-emitting control terminal. The first terminal of the fourth controllable switch is connected with a first voltage terminal. The second terminal of the fourth controllable switch is connected with the first terminal of the driving switch.

The memory capacitor includes a first terminal and a second terminal. The first terminal of the memory capacitor is connected with the second terminal of the first controllable switch and the first terminal of the second controllable switch. The second terminal of the memory capacitor is connected with the second terminal of the fourth controllable switch and the first terminal of the driving switch.

In order to solve the technical problem above, an embodiment of the disclosure provides a scanning driving circuit. The scanning driving circuit includes a pixel compensation circuit. The pixel compensation circuit includes a first controllable switch, a second controllable switch, a third controllable switch, a driving switch, an organic light-emitting diode, a fourth controllable switch, and a memory capacitor.

The first controllable switch includes a control terminal, a first terminal and a second terminal. The control terminal of the first controllable switch is connected with a scanning line. The first terminal of the first controllable switch is connected with a reference voltage terminal.

The second controllable switch includes a control terminal, a first terminal and a second terminal. The control terminal of the second controllable switch is connected with a light-emitting control terminal. The first terminal of the second controllable switch is connected with the second terminal of the first controllable switch.

The third controllable switch includes a control terminal, a first terminal and a second terminal. The control terminal of the third controllable switch is connected with the scanning line. The first terminal of the third controllable switch is connected with a data cable. The second terminal of the third controllable switch is connected with the second terminal of the second controllable switch.

The driving switch includes a control terminal, a first terminal and a second terminal. The control terminal of the driving switch is connected with the second terminal of the second controllable switch and the second terminal of the third controllable switch.

The organic light-emitting diode includes an anode and a cathode. The anode of the organic light-emitting diode is connected with the second terminal of the driving switch. The cathode of the organic light-emitting diode is connected with a ground.

The fourth controllable switch includes a control terminal, a first terminal and a second terminal. The control terminal of the fourth controllable switch is connected with the light-emitting control terminal. The first terminal of the fourth controllable switch is connected with a first voltage terminal. The second terminal of the fourth controllable switch is connected with the first terminal of the driving switch.

The memory capacitor includes a first terminal and a second terminal. The first terminal of the memory capacitor is connected with the second terminal of the first controllable switch and the first terminal of the second controllable switch. The second terminal of the memory capacitor is connected with the second terminal of the fourth controllable switch and the first terminal of the driving switch.

In order to solve the technical problem above, an embodiment of the disclosure provides a display device. The display device includes a scanning driving circuit. The scanning driving circuit includes a pixel compensation circuit. The pixel compensation circuit includes a first controllable switch, a second controllable switch, a third controllable switch, a driving switch, an organic light-emitting diode, a fourth controllable switch, and a memory capacitor.

The first controllable switch includes a control terminal, a first terminal and a second terminal. The control terminal of the first controllable switch is connected with a scanning line. The first terminal of the first controllable switch is connected with a reference voltage terminal.

The second controllable switch includes a control terminal, a first terminal and a second terminal. The control terminal of the second controllable switch is connected with a light-emitting control terminal. The first terminal of the second controllable switch is connected with the second terminal of the first controllable switch.

The third controllable switch includes a control terminal, a first terminal and a second terminal. The control terminal of the third controllable switch is connected with the scanning line. The first terminal of the third controllable switch is connected with a data cable. The second terminal of the third controllable switch is connected with the second terminal of the second controllable switch.

The driving switch includes a control terminal, a first terminal and a second terminal. The control terminal of the driving switch is connected with the second terminal of the second controllable switch and the second terminal of the third controllable switch.

The organic light-emitting diode includes an anode and a cathode. The anode of the organic light-emitting diode is connected with the second terminal of the driving switch. The cathode of the organic light-emitting diode is connected with a ground.

The fourth controllable switch includes a control terminal, a first terminal and a second terminal. The control terminal of the fourth controllable switch is connected with the light-emitting control terminal. The first terminal of the fourth controllable switch is connected with a first voltage terminal. The second terminal of the fourth controllable switch is connected with the first terminal of the driving switch.

The memory capacitor includes a first terminal and a second terminal. The first terminal of the memory capacitor is connected with the second terminal of the first controllable switch and the first terminal of the second controllable switch. The second terminal of the memory capacitor is connected with the second terminal of the fourth controllable switch and the first terminal of the driving switch.

Beneficial effects of the disclosure are distinguishing from the prior art, the pixel compensation circuit, the scanning driving circuit and the display device of the disclosure prevent the threshold voltage bias of the driving switch and the organic light-emitting diode to achieve the evenly displayed brightness of the panel.

DETAILED DESCRIPTION OF PREFERRED EMBODIMENTS

Figure 1:
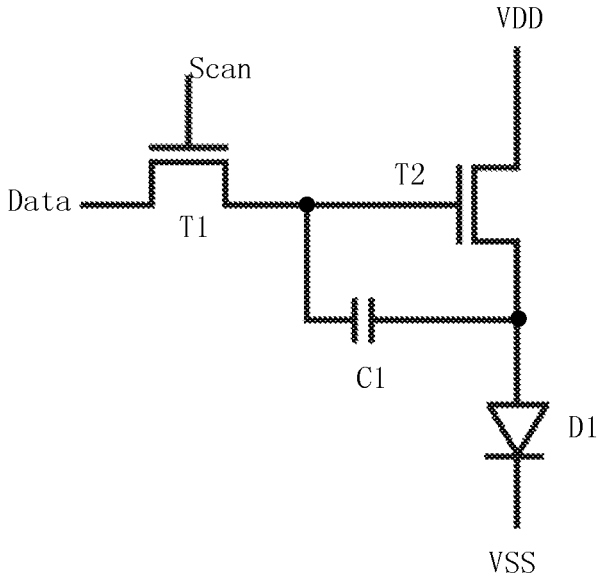
FIG. 1 (Related art)
FIG. 1 is a schematic circuit diagram of a conventional pixel compensation circuit.
Figure 2:
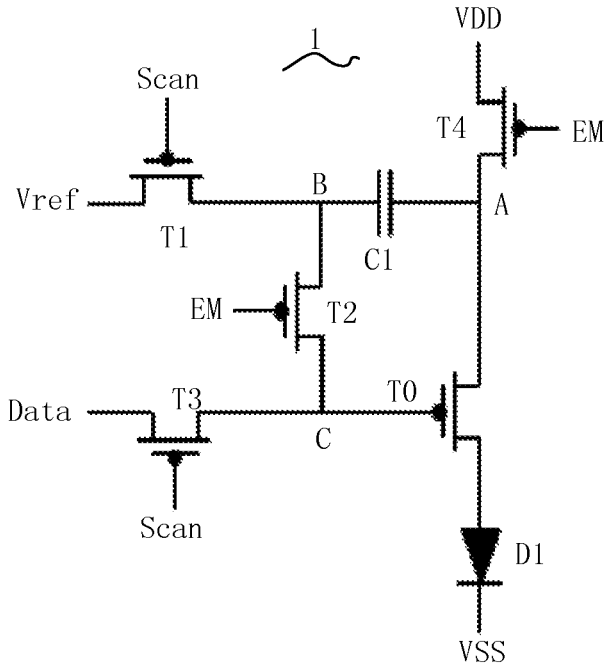
FIG. 2 is a schematic circuit diagram of a pixel compensation circuit according to a first embodiment of the disclosure.

Referring to FIG. 2, FIG. 2 is a schematic circuit diagram of a pixel compensation circuit according to a first embodiment of the disclosure. The pixel compensation circuit includes a first controllable switch T1, a second controllable switch T2, a third controllable switch T3, a driving switch T0, an organic light-emitting diode D1, a fourth controllable switch T4, and a memory capacitor C1. The first controllable switch T1 includes a control terminal, a first terminal and a second terminal. The control terminal of the first controllable switch T1 is connected with a scanning line Scan. The first terminal of the first controllable switch T1 is connected with a reference voltage terminal Vref.

The second controllable switch T2 includes a control terminal, a first terminal and a second terminal. The control terminal of the second controllable switch T2 is connected with a light-emitting control terminal EM. The first terminal of the second controllable switch T2 is connected with the second terminal of the first controllable switch T1.

The third controllable switch T3 includes a control terminal, a first terminal and a second terminal. The control terminal of the third controllable switch T3 is connected with the scanning line Scan. The first terminal of the third controllable switch T3 is connected with a data cable Data. The second terminal of the third controllable switch T3 is connected with the second terminal of the second controllable switch T2.

The driving switch T0 includes a control terminal, a first terminal and a second terminal. The control terminal of the driving switch T0 is connected with the second terminal of the second controllable switch T2 and the second terminal of the third controllable switch T3.

The organic light-emitting diode D1 includes an anode and a cathode. The anode of the organic light-emitting diode D1 is connected with the second terminal of the driving switch T0. The cathode of the organic light-emitting diode D1 is connected with a ground.

The fourth controllable switch T4 includes a control terminal, a first terminal and a second terminal. The control terminal of the fourth controllable switch T4 is connected with the light-emitting control terminal EM. The first terminal of the fourth controllable switch T4 is connected with a first voltage terminal VDD. The second terminal of the fourth controllable switch T4 is connected with the first terminal of the driving switch T0.

The memory capacitor C1 includes a first terminal and a second terminal. The first terminal of the memory capacitor C1 is connected with the second terminal of the first controllable switch T1 and the first terminal of the second controllable switch T2. The second terminal of the memory capacitor C1 is connected with the second terminal of the fourth controllable switch T4 and the first terminal of the driving switch T0.

In the embodiment, the driving switch T0, the first controllable switch T1 to the fourth controllable switch T4 are PMOS thin-film transistors. The control terminals, the first terminals and the second terminals of the driving switch T0, the first controllable switch T1 to the fourth controllable switch T4 are respectively corresponding to a gate electrode, a drain electrode and a source electrode of the thin-film transistor. In other embodiments, the driving switch, the first controllable switch to the fourth controllable switch can also be other types of switches, which can achieve the objective of the disclosure.

In the embodiment, the operational principle of the pixel compensation circuit is as follows.

In the period t1, the light-emitting control terminal EM and the scanning line Scan both output low level signals. The first controllable switch T1 to the fourth controllable switch T4 are all turned on. The data cable Data outputs the low level. The point C is the low electric potential at the moment. As the fourth controllable switch T4 is turned on, the point A is the high electric potential output from the first voltage terminal VDD.

After the period t1, the point C is still the low electric potential, and the point A is still the high electric potential. At the moment the driving switch T0 is turned on. In the period t2, the light-emitting control terminal EM outputs the high level signal. The second controllable switch T2 and the fourth controllable switch T4 both are turned off. The scanning line Scan outputs the low level signal. The first controllable switch T1 and the third controllable switch T3 are both turned on. The point B is the high level output from the reference voltage terminal Vref. The point C is the low level output from the data cable Data. The driving switch T0 is turned on. The point A discharges through the driving switch T0 and the organic light-emitting diode D1. The electric potential at the point A finally is VData−Vth(Vth<0), where Vth is the threshold voltage.

After the period t2, the compensation of the threshold voltage Vth of the driving switch T0 is completed.

Finally, after the light-emitting control terminal EM outputs the low level signal, the electric potential at the point B and that at the point C are the same. The electric potential at the point A is turned from the original VData−Vth to the output voltage of the first voltage terminal VDD simultaneously. The voltage Vgs between the gate electrode and the source electrode of the driving switch T0 is (Vref−VData+Vth)+VDD. The current in the saturation region is directly proportional to the square of (Vref−VData), which can eliminate the deviation of the threshold voltage Vth to generate the even current, and the brightness of the panel is evenly displayed.

Figure 3:
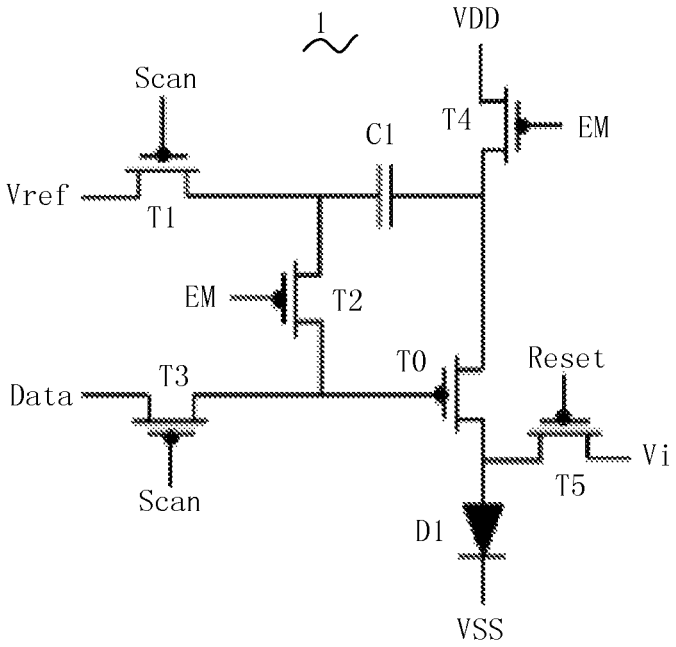
FIG. 3 is a schematic circuit diagram of a pixel compensation circuit according to a second embodiment of the disclosure.

Referring to FIG. 3, FIG. 3 is a schematic circuit diagram of a pixel compensation circuit according to a second embodiment of the disclosure. The difference of the second embodiment of the pixel compensation circuit and the first embodiment is the pixel compensation further includes a fifth controllable switch T5. The fifth controllable switch T5 includes a control terminal, a first terminal and a second terminal. The control terminal of the fifth controllable switch T5 is connected with a reset signal terminal Reset. The first terminal of the fifth controllable switch T5 is connected with the second terminal of the driving switch T0 and the anode of the organic light-emitting diode D1. The second terminal of the fifth controllable switch T5 is connected with a second voltage terminal Vi.

In the embodiment, the driving switch T0, the first controllable switch T1 to the fifth controllable switch T5 are PMOS thin-film transistors. The control terminals, the first terminals and the second terminals of the driving switch T0, the first controllable switch T1 to the fifth controllable switch T5 are respectively corresponding to a gate electrode, a drain electrode and a source electrode of the thin-film transistor. The driving switch, the first controllable switch to the fifth controllable switch can also be other types of switches, which can achieve the objective of the disclosure.

Figure 4:
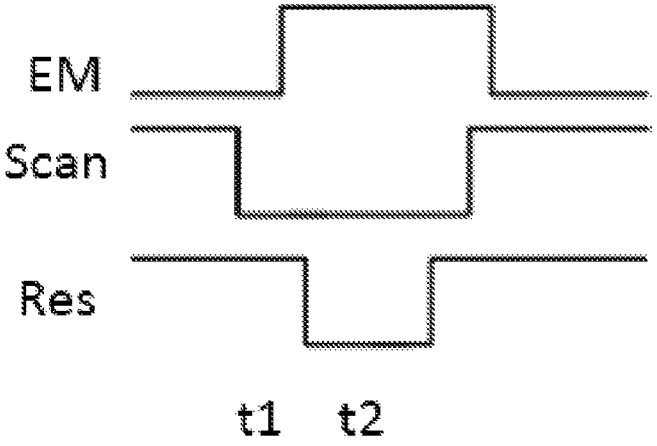
FIG. 4 is a schematic view of a sequential waveform of FIG. 3.

The operational principle of the pixel compensation circuit can be obtained according to the schematic circuit diagram of the pixel compensation circuit of FIG. 3 and the schematic view of the sequential waveform of the pixel compensation circuit shown in FIG. 4 as follows.

In the period t1, the light-emitting control terminal EM and the scanning line Scan both output low level signals. The first controllable switch T1 to the fourth controllable switch T4 are all turned on. The data cable Data outputs the low level. The point C is the low electric potential at the moment. As the fourth controllable switch T4 is turned on, the point A is the high electric potential output from the first voltage terminal VDD.

After the period t1, the point C is still the low electric potential, and the point A is still the high electric potential. At the moment the driving switch T0 is turned on. In the period t2, the light-emitting control terminal EM outputs the high level signal. The second controllable switch T2 and the fourth controllable switch T4 both are turned off. The scanning line Scan outputs the low level signal. The first controllable switch T1 and the third controllable switch T3 are both turned on. The point B is the high level output from the reference voltage terminal Vref. The point C is the low level output from the data cable Data. The driving switch T0 is turned on. The reset signal terminal Reset outputs the low level signal. The fifth controllable switch T5 is turned on. The point A leaks electricity to the second voltage terminal Vi through the driving switch T0 and the fifth controllable switch T5. The electric potential at the point A finally is VData−Vth(Vth<0), where Vth is the threshold voltage.

After the period t2, the compensation of the threshold voltage Vth of the driving switch T0 is completed.

Finally, after the light-emitting control terminal EM outputs the low level signal, the electric potential at the point B and that at the point C are the same. The electric potential at the point A is turned from the original VData−Vth to the output voltage of the first voltage terminal VDD simultaneously. The voltage Vgs between the gate electrode and the source electrode of the driving switch T0 is (Vref−VData+Vth)+VDD. The current in the saturation region is directly proportional to the square of (Vref−VData), which can eliminate the deviation of the threshold voltage Vth to generate the even current, and the brightness of the panel is evenly displayed.

Figure 5:
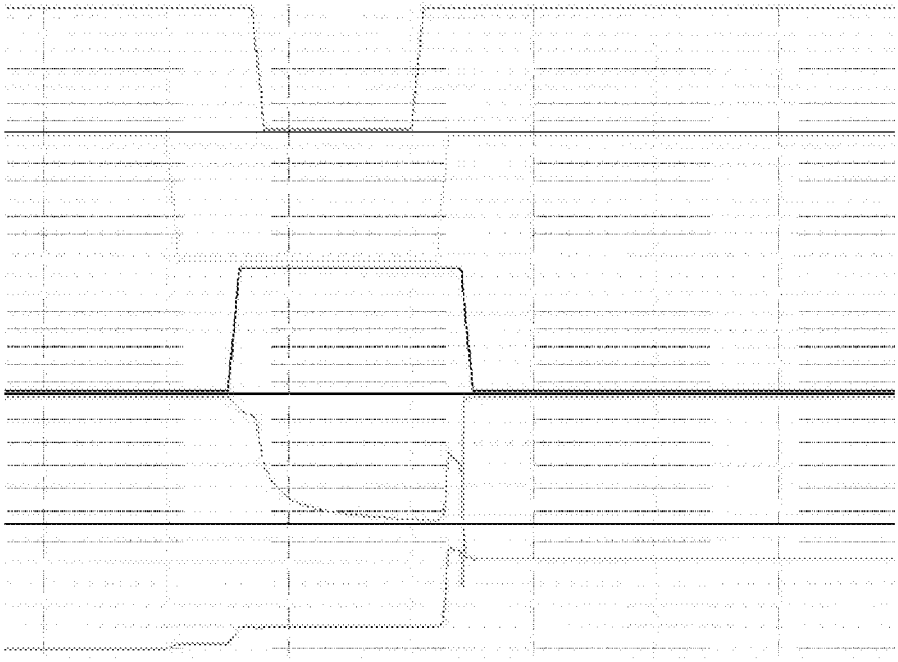
FIG. 5 is a schematic view of a simulation wave of FIG. 3.

Referring to FIG. 5, FIG. 5 is a schematic view of a simulation wave of the pixel compensation circuit according to the second embodiment of the disclosure. It can be seen from FIG. 5 that the electric potential of the point A in the pixel compensation circuit shown in FIG. 3 has an obvious process of grabbing the threshold voltage.

Figure 6:
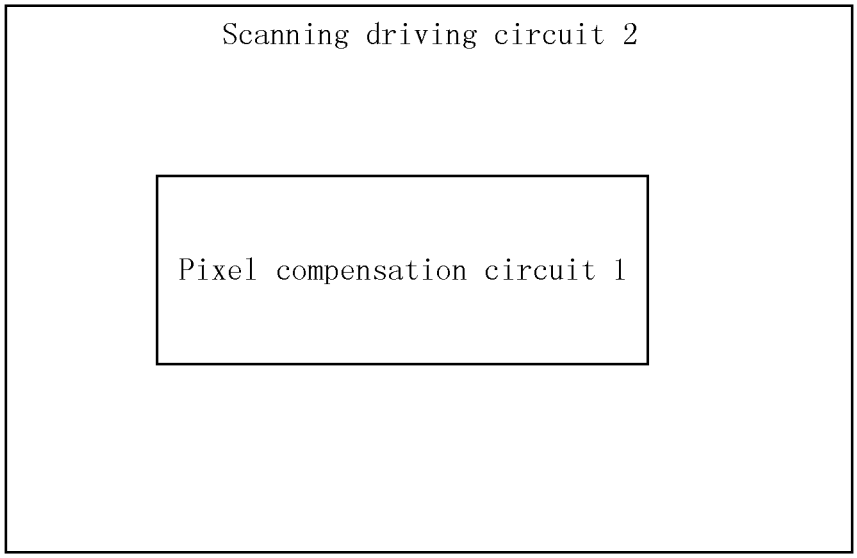
FIG. 6 is a structural schematic view of a scanning driving circuit of the disclosure.

Referring to FIG. 6, FIG. 6 is a structural schematic view of a scanning driving circuit of the disclosure. The scanning driving circuit 2 includes any one of the pixel compensation circuits 1, configured to reduce the deviation of the threshold voltage in the scanning driving circuit 2 to achieve the brightness evenness of the panel. Other elements and functions of the scanning driving circuit are identical to the elements and functions of the conventional scanning driving circuit, which will not be repeated.

Figure 7:
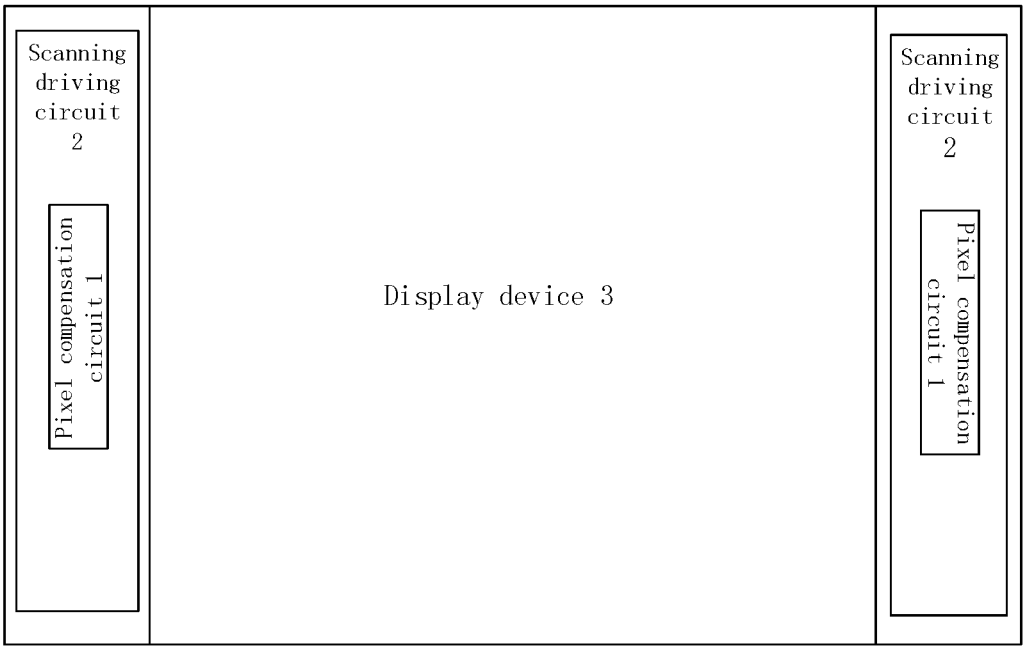
FIG. 7 is a structural schematic view of a display device of the disclosure.

Referring to FIG. 7, FIG. 7 is a structural schematic view of a display device of the disclosure. The display device 3 can be an OLED, which includes any scanning driving circuit 2 and any pixel compensation circuit 1 described above. The scanning driving circuit 2 with the pixel compensation circuit is disposed adjacently to the display device 3, such as two ends of the display device 3. Other devices and functions in the display device are identical to the devices and functions of the conventional display device, which will not be repeated.

The pixel compensation circuit, the scanning driving circuit and the display device of the disclosure prevent the threshold voltage bias of the driving switch and the organic light-emitting diode to achieve the evenly displayed brightness of the panel.

The description above is merely embodiments of the disclosure, which cannot limit the protection scope of the disclosure. Any equivalent structure or process according to contents of the disclosure and the figures, or direct or indirect application in other related fields should be included in the protected scope of the disclosure.

What is claimed is:

1. A pixel compensation circuit, wherein the pixel compensation circuit comprises:

a first controllable switch, the first controllable switch comprises a control terminal, a first terminal and a second terminal, the control terminal of the first controllable switch is connected with a scanning line, the first terminal of the first controllable switch is connected with a reference voltage terminal;

a second controllable switch, the second controllable switch comprises a control terminal, a first terminal and a second terminal, the control terminal of the second controllable switch is connected with a light-emitting control terminal, the first terminal of the second controllable switch is connected with the second terminal of the first controllable switch;

a third controllable switch, the third controllable switch comprises a control terminal, a first terminal and a second terminal, the control terminal of the third controllable switch is connected with the scanning line, the first terminal of the third controllable switch is connected with a data cable, the second terminal of the third controllable switch is connected with the second terminal of the second controllable switch;

a driving switch, the driving switch comprises a control terminal, a first terminal and a second terminal, the control terminal of the driving switch is connected with the second terminal of the second controllable switch and the second terminal of the third controllable switch;

an organic light-emitting diode, the organic light-emitting diode comprises an anode and a cathode, the anode of the organic light-emitting diode is connected with the second terminal of the driving switch, the cathode of the organic light-emitting diode is connected with a ground;

a fourth controllable switch, the fourth controllable switch comprises a control terminal, a first terminal and a second terminal, the control terminal of the fourth controllable switch is connected with the light-emitting control terminal, the first terminal of the fourth controllable switch is connected with a first voltage terminal, the second terminal of the fourth controllable switch is connected with the first terminal of the driving switch; and a memory capacitor, the memory capacitor comprises a first terminal and a second terminal, the first terminal of the memory capacitor is connected with the second terminal of the first controllable switch and the first terminal of the second controllable switch, the second terminal of the memory capacitor is connected with the second terminal of the fourth controllable switch and the first terminal of the driving switch;

wherein the pixel compensation circuit further comprises a fifth controllable switch, the fifth controllable switch comprises a control terminal, a first terminal and a second terminal, the control terminal of the fifth controllable switch is connected with a reset signal terminal, the first terminal of the fifth controllable switch is connected with the second terminal of the driving switch and the anode of the organic light-emitting diode, the second terminal of the fifth controllable switch is connected with a second voltage terminal;

wherein the driving switch, the first controllable switch to the fifth controllable switch are PMOS thin-film transistors, the control terminals, the first terminals and the second terminals of the driving switch, the first controllable switch to the fifth controllable switch are respectively corresponding to a gate electrode, a drain electrode and a source electrode of the thin-film transistor; and wherein a low level duration of a reset signal outputted from the reset signal terminal is less than a low level duration of a scan signal outputted from the scanning line.

2. A scanning driving circuit, wherein the scanning driving circuit comprises a pixel compensation circuit, the pixel compensation circuit comprises:

a first controllable switch, the first controllable switch comprises a control terminal, a first terminal and a second terminal, the control terminal of the first controllable switch is connected with a scanning line, the first terminal of the first controllable switch is connected with a reference voltage terminal;

a second controllable switch, the second controllable switch comprises a control terminal, a first terminal and a second terminal, the control terminal of the second controllable switch is connected with a light-emitting control terminal, the first terminal of the second controllable switch is connected with the second terminal of the first controllable switch;

a third controllable switch, the third controllable switch comprises a control terminal, a first terminal and a second terminal, the control terminal of the third controllable switch is connected with the scanning line, the first terminal of the third controllable switch is connected with a data cable, the second terminal of the third controllable switch is connected with the second terminal of the second controllable switch;

a driving switch, the driving switch comprises a control terminal, a first terminal and a second terminal, the control terminal of the driving switch is connected with the second terminal of the second controllable switch and the second terminal of the third controllable switch;

an organic light-emitting diode, the organic light-emitting diode comprises an anode and a cathode, the anode of the organic light-emitting diode is connected with the second terminal of the driving switch, the cathode of the organic light-emitting diode is connected with a ground;

a fourth controllable switch, the fourth controllable switch comprises a control terminal, a first terminal and a second terminal, the control terminal of the fourth controllable switch is connected with the light-emitting control terminal, the first terminal of the fourth controllable switch is connected with a first voltage terminal, the second terminal of the fourth controllable switch is connected with the first terminal of the driving switch; and a memory capacitor, the memory capacitor comprises a first terminal and a second terminal, the first terminal of the memory capacitor is connected with the second terminal of the first controllable switch and the first terminal of the second controllable switch, the second terminal of the memory capacitor is connected with the second terminal of the fourth controllable switch and the first terminal of the driving switch;

wherein the pixel compensation circuit further comprises a fifth controllable switch, the fifth controllable switch comprises a control terminal, a first terminal and a second terminal, the control terminal of the fifth controllable switch is connected with a reset signal terminal, the first terminal of the fifth controllable switch is connected with the second terminal of the driving switch and the anode of the organic light-emitting diode, the second terminal of the fifth controllable switch is connected with a second voltage terminal;

wherein the driving switch, the first controllable switch to the fifth controllable switch are PMOS thin-film transistors, the control terminals, the first terminals and the second terminals of the driving switch, the first controllable switch to the fifth controllable switch are respectively corresponding to a gate electrode, a drain electrode and a source electrode of the thin-film transistor; and wherein a low level duration of a reset signal outputted from the reset signal terminal is less than a low level duration of a scan signal outputted from the scanning line.

3. A display device, wherein the display device comprises a scanning driving circuit, the scanning driving circuit comprises a pixel compensation circuit, the pixel compensation circuit comprises:

a first controllable switch, the first controllable switch comprises a control terminal, a first terminal and a second terminal, the control terminal of the first controllable switch is connected with a scanning line, the first terminal of the first controllable switch is connected with a reference voltage terminal;

a second controllable switch, the second controllable switch comprises a control terminal, a first terminal and a second terminal, the control terminal of the second controllable switch is connected with a light-emitting control terminal, the first terminal of the second controllable switch is connected with the second terminal of the first controllable switch;

a third controllable switch, the third controllable switch comprises a control terminal, a first terminal and a second terminal, the control terminal of the third controllable switch is connected with the scanning line, the first terminal of the third controllable switch is connected with a data cable, the second terminal of the third controllable switch is connected with the second terminal of the second controllable switch;

a driving switch, the driving switch comprises a control terminal, a first terminal and a second terminal, the control terminal of the driving switch is connected with the second terminal of the second controllable switch and the second terminal of the third controllable switch;

an organic light-emitting diode, the organic light-emitting diode comprises an anode and a cathode, the anode of the organic light-emitting diode is connected with the second terminal of the driving switch, the cathode of the organic light-emitting diode is connected with a ground;

a fourth controllable switch, the fourth controllable switch comprises a control terminal, a first terminal and a second terminal, the control terminal of the fourth controllable switch is connected with the light-emitting control terminal, the first terminal of the fourth controllable switch is connected with a first voltage terminal, the second terminal of the fourth controllable switch is connected with the first terminal of the driving switch; and a memory capacitor, the memory capacitor comprises a first terminal and a second terminal, the first terminal of the memory capacitor is connected with the second terminal of the first controllable switch and the first terminal of the second controllable switch, the second terminal of the memory capacitor is connected with the second terminal of the fourth controllable switch and the first terminal of the driving switch;

wherein the pixel compensation circuit further comprises a fifth controllable switch, the fifth controllable switch comprises a control terminal, a first terminal and a second terminal, the control terminal of the fifth controllable switch is connected with a reset signal terminal, the first terminal of the fifth controllable switch is connected with the second terminal of the driving switch and the anode of the organic light-emitting diode, the second terminal of the fifth controllable switch is connected with a second voltage terminal;

wherein the driving switch, the first controllable switch to the fifth controllable switch are PMOS thin-film transistors, the control terminals, the first terminals and the second terminals of the driving switch, the first controllable switch to the fifth controllable switch are respectively corresponding to a gate electrode, a drain electrode and a source electrode of the thin-film transistor; and wherein a low level duration of a reset signal outputted from the reset signal terminal is less than a low level duration of a scan signal outputted from the scanning line.

4. The display device according to claim 3, wherein the display device is an OLED.

* * * * *